US005664553A

United States Patent [19]

Chiuminatta et al.

[11] Patent Number: 5,664,553

[45] Date of Patent: Sep. 9, 1997

[54] SPRING LOADED SKID PLATE FOR A CONCRETE SAW

[76] Inventors: Edward R. Chiuminatta, 16405 Everett, Riverside, Calif. 92508; Alan R. Chiuminatta, 1112 Olympic Dr., Corona, Calif. 91719

[21] Appl. No.: 451,466

[22] Filed: May 26, 1995

[51] Int. Cl.[6] ..... B28D 1/04

[52] U.S. Cl. ..... 125/13.01; 125/14

[58] Field of Search ..... 125/13.01, 13.03, 125/14; 451/352, 454, 455, 457; 299/39, 36; 30/373, 374, 377, 388

[56] References Cited

U.S. PATENT DOCUMENTS

| | | | |
|---|---|---|---|
| 4,903,680 | 2/1990 | Chiuminatta et al. | 125/13.01 |
| 5,056,499 | 10/1991 | Chiuminatta et al. | 125/14 |
| 5,086,750 | 2/1992 | Chiuminatta et al. | 125/13.01 |
| 5,241,946 | 9/1993 | Yelton et al. | 125/14 |
| 5,381,780 | 1/1995 | Yelton et al. | 125/14 |
| 5,575,271 | 11/1996 | Chiuminatta et al. | 125/13.01 |
| 5,579,753 | 12/1996 | Chiuminatta et al. | 125/13.01 |
| 5,579,754 | 12/1996 | Chiuminatta et al. | 125/14 |

*Primary Examiner*—Eileen P. Morgan
*Attorney, Agent, or Firm*—Knobbe, Martens, Olson & Bear, LLP

[57] ABSTRACT

A skid plate assembly for a concrete cutting saw is provided. The skid plate assembly has a slot through which the rotating cutting blade passes to cut the concrete. Springs located on opposite sides of the cutting blade resiliently bend the skid plate to counteract deformation of the skid plate as it is placed against the concrete. The spring and skid plate being sized to allow bending to accommodate variations in the flatness of the concrete surface during cutting so that it remains in sufficient contact with the surface of the concrete surrounding the cutting blade to reduce raveling.

63 Claims, 6 Drawing Sheets

22
24
30
32
34
104
60
120
122
104

SPRING LOADED SKID PLATE FOR A CONCRETE SAW

BACKGROUND OF THE INVENTION

This invention relates to devices for cutting grooves in concrete. More particularly, this invention relates to a skid plate used on a concrete saw where a rotating cutting blade extends through the skid plate to cut a groove into the surface of the concrete, preferably before the concrete has hardened.

There are advantages to cutting grooves in concrete surfaces soon after the concrete is finished, without waiting until the next day after pouring. If the concrete is cut with an up-cut rotating blade, and if it is cut before it has hardened sufficiently to avoid raveling, then it is advantageous to support the concrete surface adjacent the cutting blade during cutting as described in U.S. Pat. Nos. 4,769,201 and 5,305,729. This support greatly reduces raveling. Raveling is a term that refers to spalling, chipping, cracking or other undesirable deformation of the surface adjacent the grooves cut in concrete surfaces.

But even using saws of the type described in these patents to cut concrete shortly after it is finished, intermittent raveling of the groove edges occasionally occurs. This raveling is especially common on the larger saws that use cutting blades of about 10 inches (25 cm), or more, in diameter. This raveling is usually attributed to some unknown defect in the saw construction or to operator error of some unknown sort.

Because it is desirable to have a groove with a consistent quality of finish, and preferably to have a groove with minimal raveling, there is a need to prevent this occasional, intermittent raveling.

SUMMARY OF THE INVENTION

The Applicants have discovered that small variations in the flatness of the concrete surface can result in the skid plate losing contact with enough of the concrete surface so that the surface is cut without sufficient support to prevent raveling. The solution to this problem is to make the skid plate flexible enough to conform to variations in the surface flatness so that it supports the concrete along a sufficient portion of the cutting blade to reduce, and preferably to prevent raveling. Further, because the saw deforms the skid plate during cutting, the skid plate is also initially deformed enough to compensate for the deformation normally caused by the saw, while still permitting the skid plate flexibility needed to conform to surface flatness variations. A spring-loaded skid plate is used to achieve these advantages.

The present invention uses a concrete cutting saw having a circular concrete cutting blade, a skid plate to prevent raveling of grooves cut in wet concrete, and advantageously uses supporting wheels. The saw is advantageously used to cut grooves in concrete after the concrete is finished and before it has reached its rock like hardness, and preferably before the concrete has shrunk sufficiently to cause cracking along planes other than those planes defined by the cut grooves.

The invention comprises a method and apparatus for cutting concrete with a concrete saw which cuts grooves in a concrete surface, preferably before the concrete has hardened.

These and other aspects of the invention will become apparent from a study of the following description in which reference is directed to the following drawings.

DESCRIPTION OF THE ILLUSTRATED EMBODIMENT

Saw & Skid Plate

Figure 1:
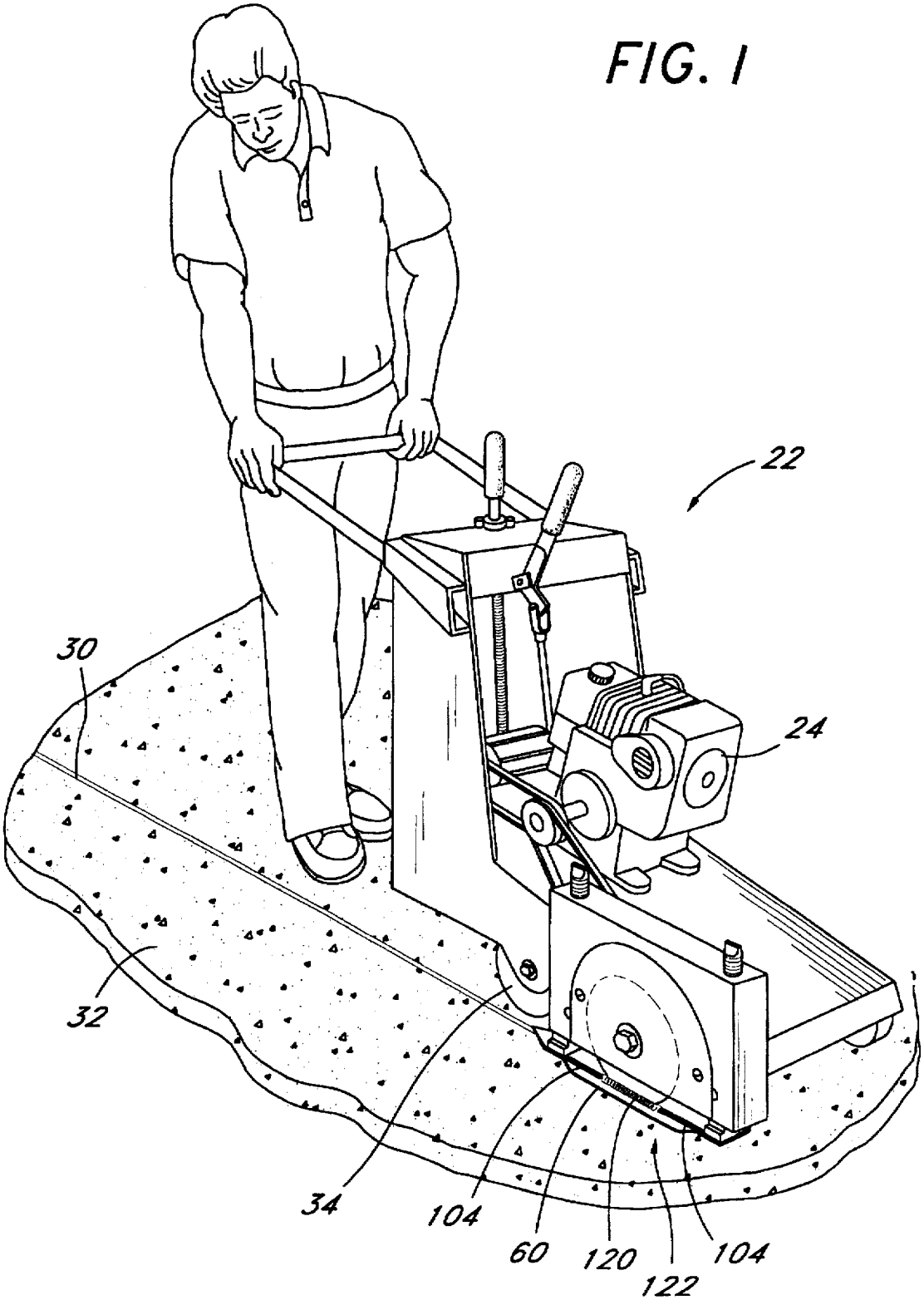
FIG. 1 is a perspective view of the concrete saw in operation.

As shown in FIGS. 1, 2, 5 and 6, a skid plate 20 is removably connected to a concrete cutting saw 22. Mounted on the saw 22 is a motor 24 that rotates a concrete cutting blade 26, preferably in an upcut direction. The blade 26 extends through a slot 28 (FIGS. 3–4) in the skid plate 20 in order to cut a groove 30 in the concrete surface 32. The saw 22 has a wheel 34, and preferably a plurality of wheels 34, supporting the saw on the concrete surface 32.

Advantageously, the saw 22 is supported while cutting the groove 30 in the concrete surface 32 by the wheels 34, and the skid plate 20, so as to provide a three-point support for the saw during cutting. A saw of this general type is described in more detail in U.S. Pat. No. 5,305,729, and the text and drawings of that patent are incorporated herein by reference. Preferably the concrete cutting blade 26 has a diameter of 8–14 inches (20–35 cm), although smaller blades of 4–6 inches in diameter (10–15 cm) may be used.

Referring to FIGS. 3–6, the skid plate 20 has a leading edge 36 at one end, a trailing edge 38 at the other end, and a middle or support portion 40 in between. The leading and trailing edges are advantageously inclined upward, away from the concrete 32 and toward the saw 22 at an inclined angle, rather than sharply perpendicular to the concrete. Leading inclined portion 42 has one end connected to the leading edge 36 (FIG. 4) and an opposing end connected to leading mounting portion 46. Trailing inclined portion 44 has one end connected to the trailing edge 38 (FIG. 4) and an opposing end connected to trailing mounting portion 48. The mounting portions 46, 48 will sometimes be referred to as the ends 46, 48 of skid plate 20.

The mounting portions 46, 48 are offset vertically a distance away from the surface of the concrete 32, so that the middle portion 40 depends from the saw 22 a distance sufficient to contact the concrete surface 32 in order to support the concrete surface during cutting and inhibit ravelling of the concrete surface 32 adjacent the groove 30. Advantageously, the mounting portions 46, 48 are offset from and substantially parallel to the middle portion 40, although the orientation of the mounting portions 46, 48 can vary to suit the particular mounting configuration of the saw 20.

Figure 4:
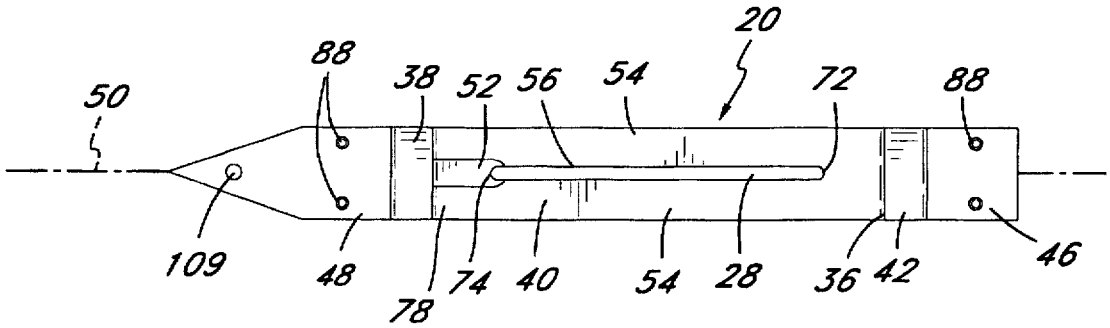
FIG. 4 is a bottom plan view of the skid plate.
Figure 6:
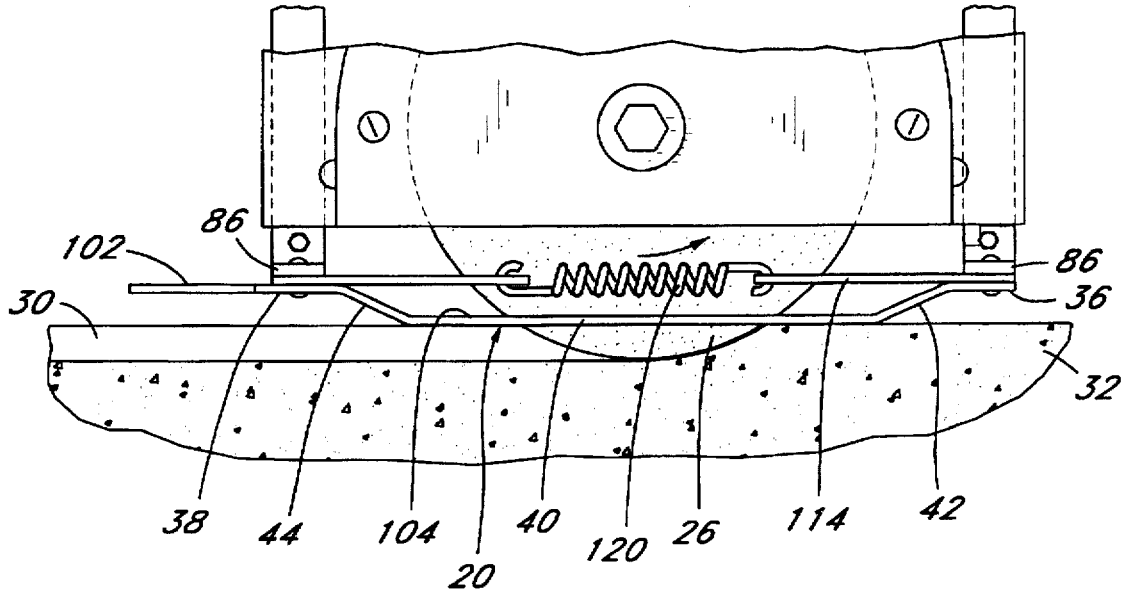
FIG. 6 is a partial side view of the blade housing and skid plate assembly during cutting.

Referring to FIG. 4, the skid plate 20 has a slot 28 which allows the cutting blade 26 to pass through the skid plate 20 into the surface of the concrete 32 (FIGS. 4, 6). This slot 28 is preferably located along a longitudinal axis 50 (FIG. 4) of the skid plate 20, which axis is generally parallel to the longitudinal axis of the saw 22. The slot 28 is preferably centered in the middle portion 40, extending from a point just behind the leading edge 36 to a point near the beginning of the trailing edge 38. The slot 28 has a leading end 72 which is closed and terminates near the leading edge 36 of the skid plate 20. The slot 28 also has a trailing end 74 which is also closed and terminates near the trailing edge 38 of the skid plate 20.

The slot 28 has inner sides 56*a*, 56*b* which extend through the skid plate 20 to the bottom of the skid plate that faces and contacts the surface of the concrete 32. At a point near the trailing end 74 of the slot 28, a recess 78 extends into the bottom surface of the skid plate 20 and extends from the trailing end 74 of the slot 28 to the trailing edge 38 of the skid plate 20. This recess 52 about the trailing end of the slot 28 prevents the skid plate 20 from trowelling over the groove 30 which has been cut. Another form of recess, a tunnel, or even a skid plate 20 with an open trailing end in slot 28, could also be used to achieve the same result.

The skid plate 20 has sides 54 which extend from the slot 28 outward. The skid plate 20 is designed to smoothly contact the surface of the concrete 32 and is therefore of sufficient width and length so as not to drag into the concrete surface 32 during cutting of concrete before it is sufficiently hard to support the weight of the saw and operator.

The sides 54 are also preferably of such a width that when concrete is brought to the surface by the cutting blade 26 and is dislodged from such blade, it is deposited primarily on the surface of the sides 54 which faces towards the concrete saw 22. Advantageously, the sides 54 are wide enough that the removed concrete dries while on the sides 54 enough so that it does not re-adhere to the concrete surface being cut. This allows the concrete which is removed while cutting the groove 30 to be deposited back onto even a wet concrete surface 32 so that it does not become part of the wet concrete surface, but can be swept away at a later time.

The middle portion 40 is preferably about 9.5 inches (24 cm) long and 2 inches (5 cm) wide, for a total area of about 19 square inches (120 square cm), when used with a cutting blade of about 10 inches (25 cm) diameter. The skid plate 20 as illustrated is about 13 inches (33 cm) long from end to end of the mounting portions 46, 48. There are thus about 19 square inches in contact with the concrete surface during cutting. While the thickness of the skid plate 20 may vary at its mounting portions 44, 46, as compared to its middle portion 40, it is preferred to have a uniform thickness for the entire skid plate 20 for ease of manufacturing. Advantageously, the middle section 40 is made of 12 gage stainless steel, which has a thickness of about 0.1046 inches (0.266 cm). This thickness correspondingly means that the slot 28 depth should also be 0.1046 inches.

It is preferred that the slot 28 have a width such that the sides 56*a*, 56*b* of the slot are as close to the sides of the cutting segments of the cutting blade 26 as possible, without contact between the cutting segments and slot sides. However, the slot 28 width must accommodate the inherent blade wobble and misalignments, and therefore the slot width must be somewhat larger than the width of the cutting blade 26. A slot width of about 0.118 to 0.120 inches (0.23–0.30 cm) is believed advantageous for the illustrated skid plate 20, although a slightly wider slot width of 0.13 inches (0.33 cm) is believed to perform satisfactorily while being slightly easier to manufacture.

A satisfactory slot 28 is believed to have a space of about 0.020 inches (0.51 mm) from each of the sides of the cutting segments, such that the total slot width is around 0.13 inch (0.33 cm) for a cutting blade 26 with cutting segments 0.09 inches thick. This tolerance should be large enough to allow for variations in cutting blade 26, as well as adequately support the concrete surface 20 adjacent the cutting blade.

The distance from the edges of slot 28 to the sides of the cutting blade 26 and cuts segments are advantageously less than 0.125 inches (3.1 cm) for concrete having a hardness of below about 1200 psi (83 kg/sq. cm). Spacings of 1/32 to 1/16 of an inch (0.07–0.16 cm) are more advantageous for such concrete, and preferably as close as possible without hitting. For harder concrete, from 1200 psi. (83 kg/sq. cm) up to about 1700 psi (117 kg/sq. cm), a spacing of about 0.25 inches (0.64 cm) from the cutting segments are believed suitable. The saw 22 is suitable for use in harder concrete, but if the concrete is too hard, then water lubrication must be used to prevent the blade 26 from overheating. These aspects are described in U.S. Pat. Nos. 4,869,201, and 5,305,729, and the specifications of those patents are incorporated by reference.

It is also desired that the slot 28 be of a length sufficient to surround at least the leading edge of the cutting segments of the cutting blade 26 as they exit from the concrete surface 32. It is also advantageous that the middle portion 40 and slot 28 support the concrete adjacent the cutting segments of the cutting blade 26 as they enter the concrete surface 32. It is even more advantageous if the slot 28 surrounds at least half the length of the cutting blade 26 in contact with the concrete surface 32, and preferably extends along the entire length of the blade 26 passing through the skid plate 20. However, because of cutting blade 26 imperfections and movement of the blade 26 relative to the skid plate 20, a tolerance wherein the slot 28 extends on each end no more than 0.25 inch (0.64 cm) further than the cutting blade is acceptable. This 0.25 (0.64 cm) inch tolerance again will provide the necessary support of the concrete surface 32 before and after the trailing edge and leading edge of the cutting blade.

Mounting The Skid Plate To The Saw

Figure 3:
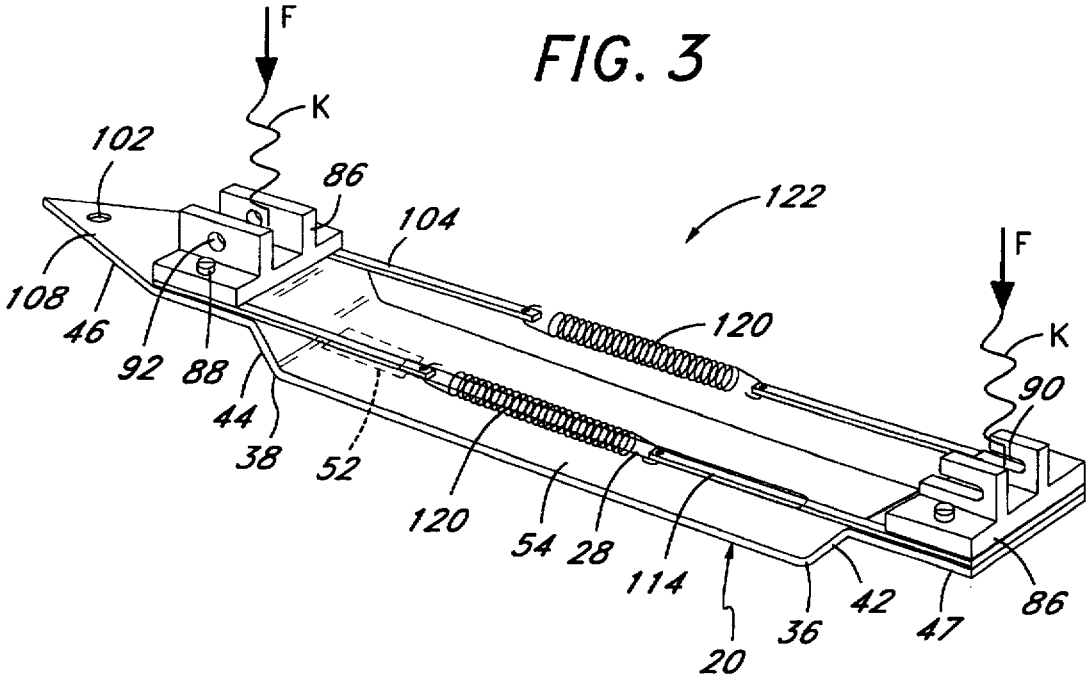
FIG. 3 is side perspective view of the skid plate assembly.
Figure 5:
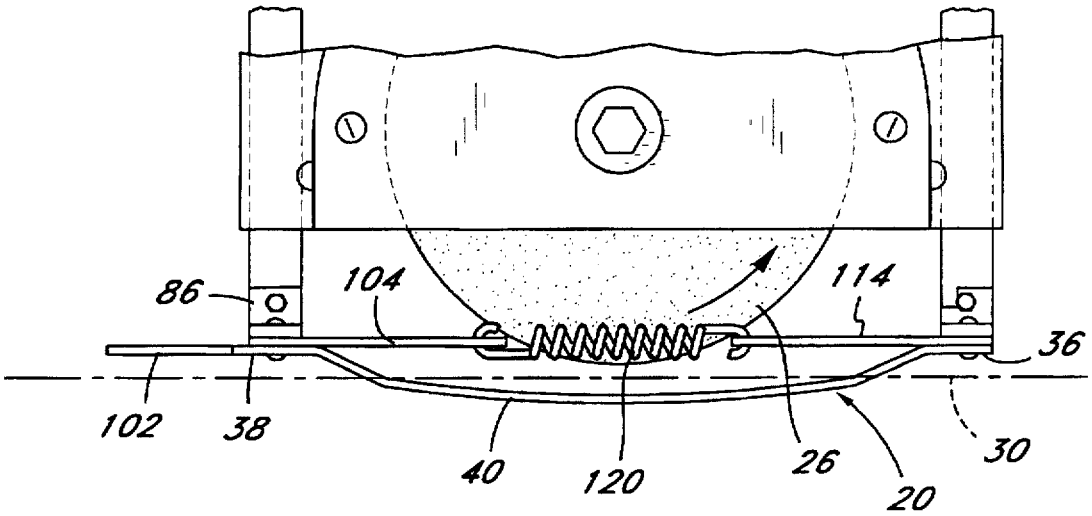
FIG. 5 is a partial side view of the blade housing and skid plate assembly just before the skid plate contacts the concrete surface.

Referring to FIGS. 3, 5 and 6, the skid plate 20 is resiliently and rotatably connected at each of its ends or mounting portions 46, 48, to the saw 22. Basically, springs K having one end connected to the saw 22 and the other end urged against the mounting portions 46, 48, resiliently urge the skid plate 20 against the concrete surface 32. A more complete description of one way to movably and resiliently connect the ends of the skid plate 20 to the saw 22 is described in U.S. Pat. No. 5,305,729.

Briefly described, The mounting has a U-shaped mounting member or mounting block 86 with apertures 90, 92 therethrough to accommodate pins that connect the skid plate 20 to the saw 22. The apertures 90, 92 preferably include a slot 90 in one mounting member 86, to allow translation as well as rotation of one of the mounting portions 46, 48 of the skid plate 20. The slotted aperture 90 permits the skid plate 20 to move laterally to compensate for the distance change when the ends of the skid plate 20 move relative to one another. Mounting members 86 are connected to the skid plate 20 by threaded fasteners 88 which pass through laterally extending flanges on the members 36 and through the skid plate. Rivets, welding, staking or adhesives could also be used.

Preferably, the mounting member 86 on the leading edge of the skid plate 20 has an elongated slot 90, with one end of the slot opening toward the trailing end of the skid plate, as shown in FIG. 3.

Spring Loaded Skid Plate Assembly

Figure 7:
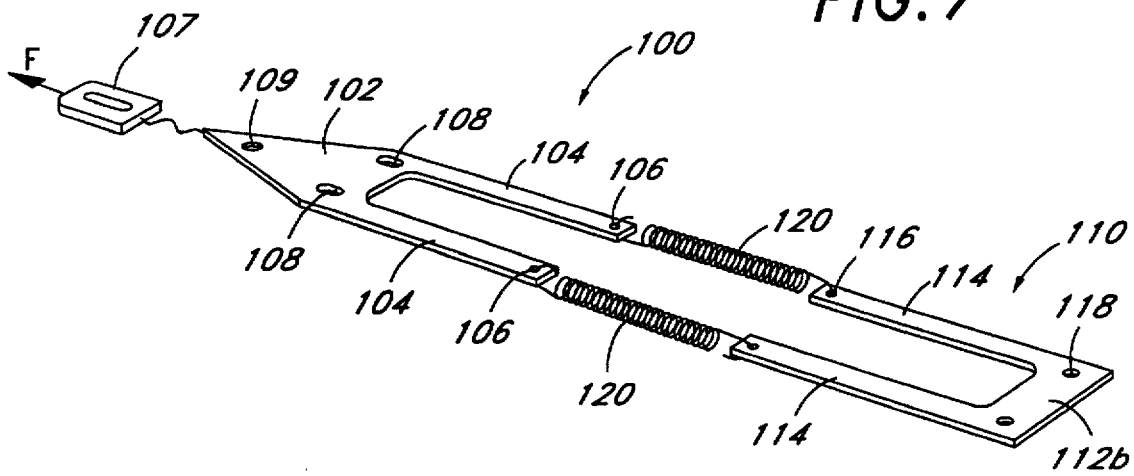
FIG. 7 is a perspective view of the spring loaded truss and one pre-load mechanism.

Referring to FIGS. 3 and 7, a trailing truss 100 has a triangular point 102 on one end, and on the opposing end narrow arms 104 extending away from the point 102. The point 102 can be used to visually sight the groove 30 and help maintain alignment of the saw 22 during cutting. A hole 106 is placed in the end of each arms 104. A pair of apertures 108 are placed in the triangular point 102, and located so that fasteners 88 can extend through the apertures and clamp the truss 100 between the trailing mounting portion 48 and the trailing mounting block 86. An aperture 109 is placed along the center, and toward the end of the triangular point 102.

A leading truss 110 has a generally rectangular base 112 with two arms 114 extending perpendicularly therefrom. Holes 116 are placed in the end of each arm 114. A pair of apertures 118 are placed in the base 112, located so that fasteners 88 can extend through the apertures and clamp the truss 100 between the leading mounting portion 46 and the leading mounting block 86. The arms 114 extend toward arms 104, and are preferably in substantially the same plane.

The width of the trusses 100, 110 are advantageously about the same width as the skid plate 20. The trusses 100, 110 are cut or punched out of thin metal, preferably steel, that is subsequently cadmium coated to prevent rusting. Steel about 0.03 to 0.04 inches thick (0.08 to 0.1 cm) is believed suitable.

An elastic or resilient memeber, such as extension coil spring 120, is connected between the holes 106, 116 in the ends of the arms 104, 114, to provide a predetermined tension in each of the pair of arms 104, 114. Thus, there are preferably two springs 120, which when connected to the arms 104, 114, result in one spring 120 on each side of the cutting blade 26. A spring loaded skid plate assembly 122 (FIG. 3) is thus formed by the skid plate 20, the trusses 100, 110, springs 120, and mounting blocks 86.

The springs 120 cause a predetermined force that bends the skid plate 20 by a predetermined amount that is preferably selected to completely or partially offset the bowing that occurs when the skid plate 20 is placed against the concrete surface 32 for cutting. Alternately phrased, the objective of springs 120 is to offset or help offset the bending moment that the saw 22 applies to the ends of the skid plate 20 when the skid plate 20 is placed against the concrete 32 for cutting.

Figure 2:
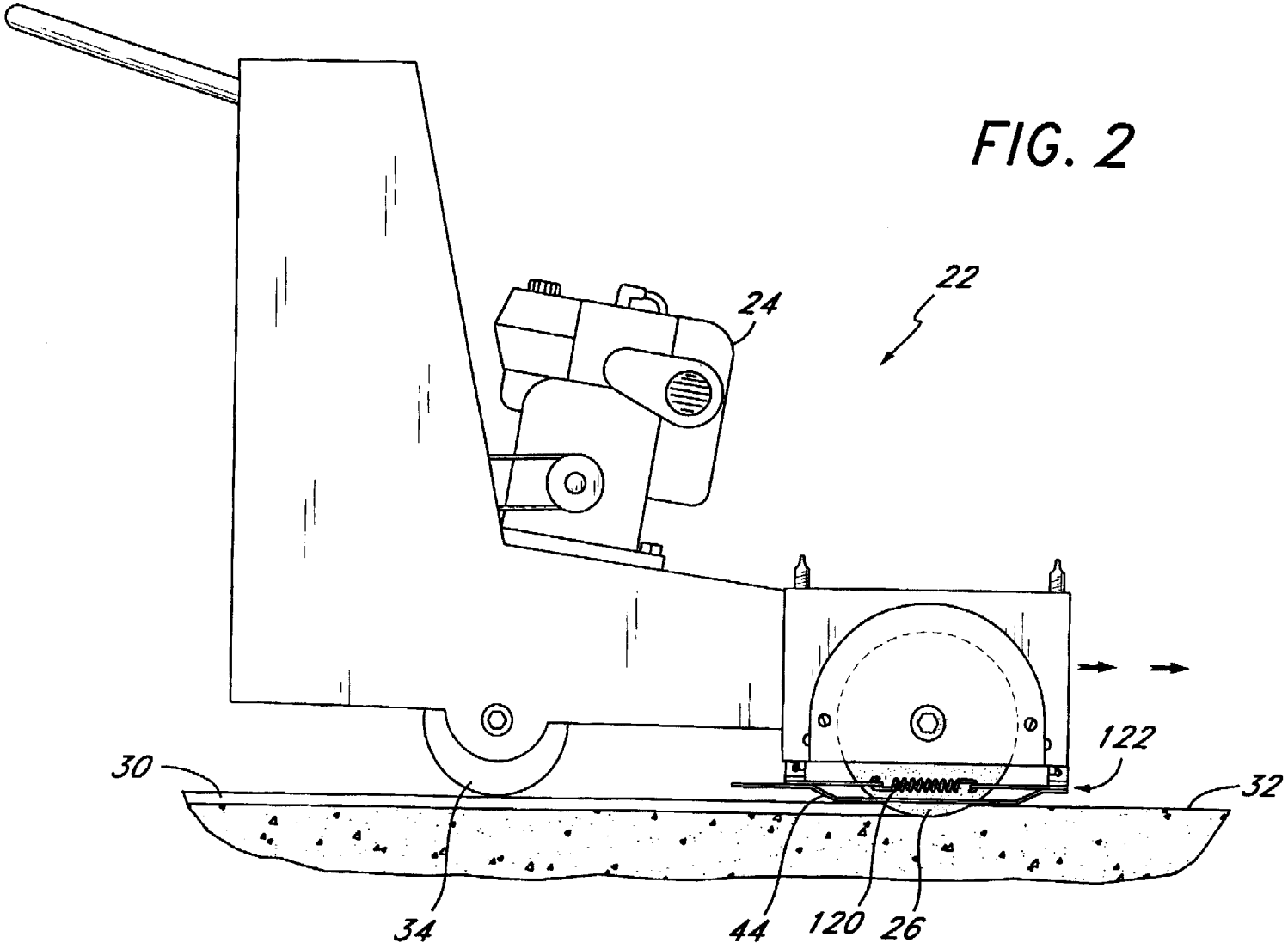
FIG. 2 is a up side view of the saw in operation.

The saw 22 applies forces on the end portions 46, 48 of the skid plate that bow the skid plate 20, and in particular, that bow the middle or support portion 40. In the described embodiment, the support portion 40 is permanently bowed or bent, but not enough to completely offset the bending from the saw 22. The bending from springs 120, when combined with this initial deformation, substantially offset the bending from the saw 22 so the support portion 40 is flat against the concrete surface 32 during cutting as shown in FIGS. 2 and 6. While the springs are thus described as providing insufficient force to completely bow the skid plate 20 to offset the weight exerted by the saw 22, it is believed possible that the springs could provide all the needed bending force for a skid plate 20 that has an initially flat support portion 40. Preferably, however, the springs provide only part of the bowing force, as described in more detail later.

The predetermined spring force may be applied to the skid plate assembly 122 in several ways. One way is to predetermine the lengths and sizes of the springs 120, arms 104, 114, the holes 106, 116 and the apertures 108, 118, relative to the location of the fasteners 88, so that when assembled, the correct amount of pre-load occurs. Of course the correct amount of preload may vary according to the particular configuration of saw and skid plate, but the desirable amount of preload can be readily determined by one of skill in the art given the present disclosure.

For the illustrated embodiment, suitable springs 120 have a coil diameter of 7/16 inches (1.1 cm.) and about 60 active coils. Springs 120 have a wire diameter of about 0.05 inches (0.12 cm). An extended coil length of about 3 and ¾ inches (9.6 cm) and an unextended coil length of about 2 and ⅞ inches (7.3 cm), has been found suitable. These springs 120 have an initial tension of about 1.25 pounds (0.56 kg), and a spring constant or spring rate of about 2 lb/in (0.35 kg/cm). When attached to the skid plate 20, the two springs 120 exert about 6 pounds (2.7 kg) total force. As the spring 120 are offset form the middle portion 40 about 0.6 inch, they exert a bending moment on the skid plate 20 of about 3.6 inch pounds (6 lb×0.6 in=3.6 in-lb) or 4.1 kg-cm (2.7 kg×1.5 cm=4.1 kg-cm).

The arms 104, 114 are about ⅛ inch wide (0.3 cm) and about 3 and ¼ inches long (8.3 cm). The arms 104, 114 are about 0.6 inches (1.3 cm) above the middle portion 40 of skid plate 20. The distance between the center of fasteners 88 in the leading and trailing ends 44, 46 of skid plate 20 is about 12.1 inches (30.7 cm). That particular skid plate 20 is about 2.5 inches wide (6.4 cm), with leading and trailing mounting portions 44, 46 each about 1.2 inches long (3 cm), inclined portions 42, 44 each about 0.8 inches in length (2 cm), and an end to end length of skid plate 20 of about 13.1 inches (10.5 cm). That particular skid plate 20 can advantageously be used with a 10 inch diameter (25 cm) concrete cutting blade 26, with a force of about 18 pounds being exerted on each end of the skid plate 20.

There are numerous ways to apply the pre-load to springs 120 and cause the pre-bowing to completely, or at least partially offset the deformation from the saw 22. For example, referring to FIGS. 3 and 7, a person could clamp one truss 100, 110 between the mounting block 86 and the respective skid plate mounting portion 46, 48, while applying a predetermined tension on the other truss 100, 110. This could be done, for example, by fastening the leading truss 110 between block 86 and leading mounting portion 46. A spring scale 107 could be hooked through aperture 109 and used to apply a predetermined force to the trailing truss 100. Making apertures 108 elongated would allow movement along an axis parallel to the longitudinal axis 50. When the scale 107 indicated the desire pre-load, fasteners 88 could clamp the trailing truss 100 between the block 86 and the trailing mounting portion 44 of the skid plate 20. Again, riveting, welding, staking, or gluing could be used to hold these parts together once they are preloaded.

Yet another way to apply the pre-load is through eyelets screwed into the blocks 86, with arms 104, 114 having one end connected to the eyelets rather than to the point 102 or base 112. Screwing the eyelets into, or out of the blocks 86 could vary the length to adjust the pre-load. Other ways to apply a fixed pre-load, or to adjust the pre-load at the time of assembling the skid plate, will be determinable by one of ordinary skill in the art, given the information and objectives described in this specification and drawings.

In whatever way it is applied, the pre-load exerted on and by springs 120 is preferably applied symmetrically about a vertical plane extending through the slot 28 and perpendicular to the support portion 40. This is the same plane in which the cutting blade 26 preferably rotates. A non-symmetrical force would cause a twisting of the skid plate 20, and if of sufficient magnitude, could prevent adequate contact with and support of the concrete surface 32 during cutting. Because the cutting blade 26 extends through slot 28, two springs 120 are advantageously used to apply this pre-load, one on each side of cutting blade 26. It is possible to use a single spring 120 on the centerline of the slot 28, but the configuration must accommodate movement of the cutting blade 26 through slot 28, and must not distort the skid plate 20 sufficiently to cause a non-uniform support of the concrete surface 32 as to cause raveling during cutting.

Operation of the Spring Loaded Skid Plate Assembly

Figure 9:
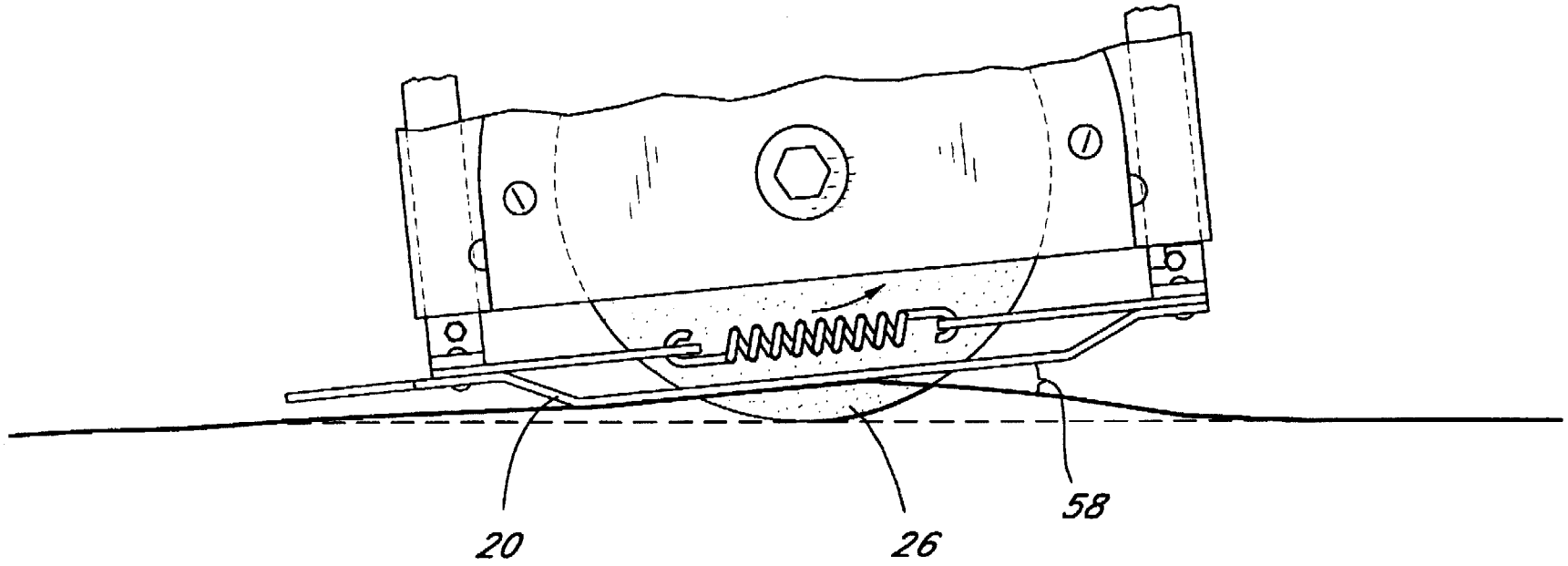
FIG. 9 is a side perspective view of a pre-bowed skid plate assembly.

Referring to FIG. 9, applicants have discovered that the concrete surface 32, especially if it is machine trowelled very early, will sometimes have local variations. These variations may range from about 1/16 to 1/8 of an inch variation (about 0.16–0.32 cm) over the length of the support portion 40, which length is about 9.5 inches (24 cm) for a 10 inch (25 cm) diameter cutting blade 26. Applicants have further observed that these variations often take the form of a hump or depression varying in diameter from 6 inches to 3 feet (15 cm to 0.9 m). A common specification for concrete flatness is about ¼ inch (about 0.6 cm) per 10 feet (3 m), and in unusual circumstances the flatness could occur very locally, such that Applicants believe the surface flatness could vary up to ¼ inch (0.6 cm) per foot (30.5 cm).

These local variations in surface flatness, while small, can nonetheless cause small spaces or gaps 58 between support portion 40 and the concrete surface 32 that cause raveling during cutting. That local flatness variations in the concrete surface 32 could cause raveling of the cut grooves was very unexpected.

Referring to FIG. 9, if the concrete surface has a locally convex area, a hump or bulge, then a skid plate 20 pre-bowed toward the concrete is being urged to bend in the direction opposite that needed to conform to the convex area, and the prior art trussed skid plates are far too stiff to bend in the opposite direction and maintain the skid plate 20 in sufficient contact with the concrete surface 32 to prevent raveling. When the convex area causes the skid plate 20 to leave contact with the concrete surface 32, ravelling occurs. This raveling is especially prone to occur adjacent the location where the cutting blade 26 exits the concrete surface 32 and to a lesser extent, is can also occur adjacent the location where the cutting blade 26 enters the concrete.

Thus, if the skid plate 20 is so stiff that the middle portion 40 of the skid plate does not adequately support the concrete surface 32 at any time when the skid plate moves over the bump raveling occurs with even small gaps between the skid plate and the concrete surface.

Similar gaps 58 can be formed when the skid plate enters, exits or traverses a concave or convex area, and raveling can occur on these occasions as well. Various combinations, locations and arrangements of these humps and depressions can occur in concrete. If any such combination causes a gap 58 and a resulting insufficient support along a sufficient portion of the cutting blade 26, then raveling can occur.

The amount of raveling appears to vary with the size of the gap 58 between the skid plate 20 and the concrete surface 32, the length of the gap 58 along the portion of the cutting blade extending through the slot 28, the location of the gap 58 along the length of the cutting blade, and the hardness of the concrete during cutting. Raveling occurs most easily if the gap 58 is at or adjacent to the location where the upcutting blade 26 exits the concrete surface 26. Raveling occurs more easily if the concrete hardness is below about 1700 psi (117 kg/sq. cm) during cutting. Raveling occurs even more easily if the concrete hardness is below about 1200 psi (83 kg/sq. cm), and especially occurs if the concrete is between about 600–900 psi (41–62 kg/sq. cm), where the concrete is often cut with a skid plate 20.

It has been found advantageous to slightly pre-bow the skid plate 20, to offset the deformation caused by that portion of the saw 22 that is supported by skid plate 20. The length of the skid plate 20 compared to its width and thickness resulted in the skid plate bowing during use, when the saw 22 applied forces at the ends 46, 48 of the skid plate (FIGS. 5–6). The constraining members slightly pre-bowed the skid plate opposite to the bowing that occurred during use, so the middle portion 40 was substantively flat during cutting. Unfortunately, the constraining members that pre-bow the skid plate also make a very rigid assembly that resists bending and flexing and thus small gaps 58 resulted in raveling.

Applicants have addressed this raveling problem as follows. To reduce raveling while maintaining the pre-bowing, the stiffness and location of the resilient member or members, such as springs 120, are selected to bow the skid plate 20 to offset the deformation caused by the saw 20. The springs 120 can completely offset the deformation caused by the saw 20. Preferably, however a combination of springs 120, and a slight permanent bowing of the segment portion 40 are used to completely, or at least substantially offset the bowing of the support portion 40 from the saw 22.

Further, the dimensions of the skid plate 20 are selected to allow the skid plate 20 to resiliently bend and conform to the local variations in the concrete flatness, and the springs 120 are selected to permit such bending of the skid plate 20. The skid plate stiffness is thus advantageously selected to allow the skid plate 20 to bend during operation in order to maintain sufficient contact between the middle or support portion 40 and the concrete surface 32 to reduce, and preferably prevent, raveling.

The support portion 40 preferably has a thickness of about 14 gage (0.0747 in., 0.1897 cm). Thicknesses of about 13–16 gage (0.0897–0.0598 in, 0.2278–0.1519 cm) are believed advantageous, depending in part on the width and length of the support portion 40. A 12 gage (0.1046 in, 0.2657 cm) thickness is believed marginally acceptable as it is fairly stiff, while a 10 gage (0.1345 in., 0.3416 cm) thickness is believed too stiff to allow sufficient deformation for most configurations of skid plates 20. A thickness of about 17–18 gage 0.0538–01478 in., 0.1367–0.1214 cm) is believed marginal, as it is so thin that the force from the saw may sometimes bow the support portion 40, and as it will wear out sooner. A thickness of 20 gage (0.0359 in., 0.0912 cm) is believed to thin and flexible for support portion 40.

The length of the skid plate 20 is often strongly affected by the diameter of the cutting blade 26, and the width strongly affected by the hardness of the concrete 32 being cut. It is desirable to have enough area on the support portion 40 so that there is less than about 1–2 pounds per square inch pressure (0.6–0.13 kg/square cm), when cutting concrete below 1200 psi (63 kg/sq. cm). For a given width and length of the skid plate 20, the pertinent stiffness is primarily determined by the thickness of the middle portion 40 through which the slot 28 extends.

The size and location of the resilient members, such as springs 120, affect the pre-bowing and the ability of the skid plate 20 to conform to variations in the concrete surface. In the depicted skid plate 20 the centerline of the springs 120 are offset about 0.6 inches (1.5 cm) from the centerline of support portion 40. This offset, combined with the force exerted by the springs 120, causes a bending force that slightly bows the support porter 40 toward the concrete surface 32. This spring force and bowing are preferably selected to completely counteract the force exerted on the ends 46, 48 of the skid plate by the saw 22 so that the middle portion 40 is flat against the concrete 32 during cutting, or at least so that the middle portion 40 supports enough of the cutting blade 26 to substantially reduce raveling.

As noted above, for the specific dimensions of the skid plate 20 described in detail herein, the saw 22 exerts a force of about 18 pounds (8 kg) on each end of the skid plate 20, and does so through the mounting members 86. Those 18 pound forces are applied about 12.3 inches (31.2 cm) apart, and about 1.5 inches (3.8 cm) from opposing edges 36, 38 of the support portion 40.

As mentioned, the support portion 40 is partially and permanently bent or bowed so that it partially offsets the force from the saw 22. The springs 120 provide a force of about 6 lbs (2.7 kg), not the total force needed to completely offset the bending force from the saw 22 during cutting. The skid plate 20 is bowed to provide the remaining offset. That is, the support portion 40 is permanently bent so it bows toward the concrete surface 32 as shown in FIG. 5. That pre-bending, when combined with the force from the springs 120, results in sufficient bowing to completely offset the bowing from the weight of the saw 22 during cutting, so the support portion 40 is flat during cutting (FIGS. 4–5). The particular forces needed will vary with the amount of force exerted by the saw 22, the specific construction of the skid plate 20 and how the skid plate 20 is mounted to the saw 22.

The resiliency and extension of the springs 120 are selected to allow the skid plate 20 to bend and conform to the local variations in the concrete surface 32. If the springs 120 are too stiff, then the skid plate 20 does not flex enough, a gap 58 forms between the skid plate and the concrete surface 32, and raveling occurs. If the springs 120 are too weak, then the skid plate 20 bends too easily, and the force exerted on the ends 46, 48 of the skid plate by the saw 22 cause the skid plate to deform too much and form gaps 58 as the localized concave and convex areas of the concrete are cut. Further, if the springs 120 are too weak, then in the illustrated embodiment the force exerted by the saw 22 on the ends of the skid plate 20 cause the center of the support portion 40 to bow away from the concrete 30 even on a flat surface, and that can also cause raveling.

The spring location relative to the skid plate, the spring stiffness, and the skid plate stiffness, are believed to interact, such that a change in one affects the others. But given the present disclosure that identifies the problem and how to solve it, one of skill in the art is believed able to derive appropriate combinations of springs and skid plates suitable for a variety of different skid plate sizes and configurations.

Further, stiffness is inversely proportional to flexibility. Thus, the references to the skid plate or spring stiffness could be phrased as references to the skid plate's flexibility or the spring's flexibility. For ease of reference, only the stiffness was used in the description, but given the present disclosure, one of skill in the art would understand how to determine a skid plate and spring with either suitable flexibility or with suitable stiffness.

In the embodiment illustrated in FIGS. 5–6, the skid plate 20 is shown mounted to the saw 22 by generally horizontal mounting portions 46, 48 extending away from the middle portion 40 so as to cause the skid plate 20 to bow away from the concrete 32 during operation, and so as to require a compensating pre-bowing of the skid plate 20 toward the concrete. If the mounting portions curved back over the middle portion 40, the skid plate 20 would bow toward the concrete during operation, and require a compensating pre-bowing away from the concrete. If the mounting portions were vertical or inclined at an intermediate angle, the bowing and pre-bowing would vary according to the particular geometry. In all mounting configurations, it is believed that one skilled in the art, having read the present disclosure, would be able to select appropriate spring sizes and locations, and skid plate sizes to solve the problems described herein. Further are skilled in the art could pre-bow the support portion 40 enough to completely or partially offset the bowing from the saw 22.

The spring rate of each spring 120 is about 2 lb/in (0.35 kg/cm), for the described skid plate 20. Other suitable springs and spring rate will be suitable for different lengths, widths and thickness of the skid plate 20, and for different amounts of permanent pre-bowing of the support portion 40. In general though, spring rates of less than 50 lb/in (8.7 kg/cm) are believed suitable for skid plates 20 that have some pre-bowing. Advantageously, spring rates of 1–10 lb/in (0.17–1.7 kg/cm) may be used for what are envisioned to be the more common sizes of skid plates, although spring rates under 1 lb/inch are believed possible if the skid plate 20 is thin enough, long enough, or if the spring force is applied far enough away from the middle portion 40 so that a large bending moment is induced for a small spring force. Because two springs 120 are used in parallel, the total spring rate for the skid plate assembly 122 is thus advantageously between about 2–20 lb/in (0.34–3.4 kg/cm) for the most common skid plates 120.

If the skid plate 20 is not pre-bowed to some degree, then the springs 120 provide all the force to offset the weight of the saw 22 that is placed on the skid plate 20. In such cases, it is believed suitable for each spring 120 to have a spring constant of up to 100 lb/in (17.5 kg/cm) for various configurations of the skid plate 120. Preferably, though, the support portion 40 is permanently pre-bowed, so that the force and spring rate of springs 120 are the lower numbers discussed above. Alternatively, the skid plate can be thin and flexible enough so that a lower spring rate of under 20 lb/in (3.4 kg/cm) can be used These spring rates are small relative to the stiffness of the load bearing members described in U.S. Pat. No. 5,305,729 (Col. 12:3–23), which use 0.25 inch (0.64 cm) wide aluminum or 0.5 inch (1.3 cm) steel straps, and have stiffness of almost 30,000 and 160,000 lb/in (5250–280,000 kg/cm), respectively, for the length of a skid plate 120. As reflected by these relative stiffness, the trussed skid plate assembly described in U.S. Pat. No. 5,305,729, was inflexible.

In contrast, because the springs 120 have a relatively low spring constant, the springs 120 can extend further and allow the middle portion 40 to flex and conform to local variations in the concrete surface 132. As the concrete surface can typically vary about 0.125 inches (0.32 cm) per foot, the springs 120 must be flexible enough to allow deformation of skid plate 120 to accommodate these local variations. If used on concrete surfaces 32 with even greater local variations, the springs 120 must accommodate even greater deformations of the skid plate 20.

While the resilient member has been shown in the above description by a coil spring 120, other resilient members can be used by one of ordinary skill in the art, given the present disclosure. For example, different types of springs could be used, such as torsion springs. Resilient members made of suitable elastic rubbers or polymers could also be used, and given the disclosures in this application such members would be readily ascertainable by one of skill in the art.

Further, instead of having a spring 120 with arms 104, 114 on opposite ends of the spring, the spring 120 could be attached to a single long arm on one end. Still further, the spring 120 could have at least one end connected to one of the mounting block 86, the mounting portions 46, 48, or the inclined portions 42, 44, and still urge the support portion 40 to bend.

Figure 8:
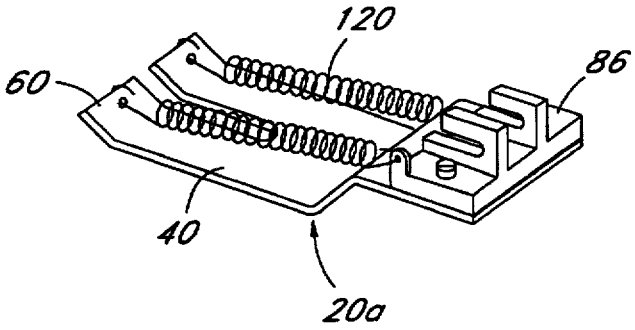
FIG. 8 is a side perspective view of an alternate embodiment of the skid plate assembly.

A further embodiment is shown in FIG. 8, in which like numbers refer to like parts. Only one mounting portion 46 is used in this alternate embodiment, with the spring members 120 interposed between a trailing end 60 of the skid plate 20*a* and either the mounting member 86, or the saw 22 (not shown) in order to resiliently bow the support portion 40 of skid plate 20*a*. The above described ways to apply the preload to the truss can be modified as needed to work with the embodiment of FIG. 8.

In both the embodiment of FIG. 8 and the previously illustrated embodiment, the springs 120, and variations thereon, provide resilient means for communicating with opposing ends of the support portion to exert a bending force of sufficient magnitude to maintain the support portion in contact with the concrete surface during cutting to reduce raveling, especially when used with a support portion that is pre-bent to at least partially offset the deformation caused by saw 22 during cutting on a flat concrete surface (FIGS. 5–6).

Given the disclosure herein, various other ways of implementing the skid plate flexibility and resiliently accommodating the skid plate deformation could be devised by one skilled in the art without undue experimentation.

Cutting Wet Concrete

The present method and apparatus are especially suitable for cutting concrete before it has reached its typical, rock-like hardness. If the concrete has attained its typical, rock-like hardness, there is little advantage to supporting the concrete during cutting with the skid plate 20, as raveling is not likely to occur if the concrete is cut properly by a down-cut rotating blade even without a skid plate.

Preferably, the cutting preferably occurs about two hours after pouring or at such time as the saw 22 can be moved across the concrete surface 32 without unacceptably marking the concrete surface 32. Because the concrete can be cut by the saw 22 while the concrete is not yet hard, the size of the slot 28 surrounding the cutting blade 26 must be designed to provide support to the concrete surface 32 surrounding the cutting blade sufficient to prevent ravelling of the groove 30, as discussed above.

Advantageously, the saw 22 which movably support the saw on the concrete surface 32 during cutting are sized so that the portions supporting the saw on the concrete will not leave permanent indentations of more than 1/16 of an inch (0.159 cm) in the concrete. No permanent indentations at all are preferable. To a lesser extent, the support portions also could be considered to be the skid plate 20 as it is urged against the concrete 32 with a predetermined force, and to that extent helps support a portion of the saw 22.

The saw 22 is also believed suitable for cutting grooves 30 without raveling when the concrete has a hardness such that a steel rod weighing about 5.75 pounds, having a diameter of 1.125 inches, when dropped from a height of about 24 inches from the surface of the concrete makes an indentation of about 0.5 inches (1.27 cm) with a flat end of the rod. The supporting portions primarily include the wheels 34.

The saw 22 and skid plate 20 are also believed suitable for cutting grooves 30 in harder concrete without raveling, as where the above described rod produces indentations of 1/32 of an inch or less. Preferably, the saw 22 and skid plate 20 are used before the concrete 32 cracks, and ideally, before the concrete reaches a hardness of about 1200 psi (83 kg/sq. cm). The saw 22 and skid plate 20 can also be advantageously used on concrete with a hardness below about 1700 psi (117 kg/sq. cm). As the saw 220 is used to cut harder concrete, the downward force on the cutting blade 26 may need to be increased, while the force on the skid plate 20 may be reduced, so long as sufficient force is applied to maintain support to the concrete adjacent the groove to inhibit raveling of the concrete at the cut groove.

It will be understood that the above described arrangements of apparatus and the methods therefrom are merely illustrative of applications of the principles of this invention and many other embodiments and modifications may be made without departing from the spirit and scope of the invention.

What is claimed is:

1. A skid plate assembly for use with a concrete saw having a rotating cutting blade with a leading cutting edge that cuts a groove in a concrete surface as the saw is moved over the surface, comprising:

a first and second mounting portion on the skid plate configured to be releasably fastened to the concrete saw so that the skid plate can be replaced periodically;

a support portion having a slot through which the cutting blade extends during cutting, the support portion depending from the first and second mounting portions such that during cutting the support portion supports the surface of the concrete adjacent at least the leading cutting edge of the blade to reduce raveling of the edges of a groove cut by the rotating blade as the skid plate moves across a portion of the surface of the concrete during cutting;

at least one spring interposed between the mounting portions to resiliently urge the support portion into a bent configuration while permitting the support portion to flex sufficiently to accommodate local variations in the flatness of the concrete surface while still maintaining the support of the concrete surface adjacent at least the location where the cutting blade exits from the concrete surface during cutting.

2. A skid plate assembly as defined in claim 1, wherein the spring has a spring rate of less than about 50 lb/in.

3. A skid plate assembly as defined in claim 1, wherein there are two springs, one on each side of the cutting blade.

4. A skid plate assembly as defined in claim 1, wherein there are two springs, each with a spring rate of less than about 10 lb/in.

5. A skid plate assembly as defined in claim 1, wherein the support portion is permanently bent in a direction that offsets the deformation exerted by the saw on a flat surface, and wherein the spring rate is less than about 10 lb/in.

6. A skid plate assembly as defined in claim 1, wherein the support portion has a thickness of between about 13–16 gage.

7. A skid plate assembly as defined in claim 1, wherein the slot is of substantially uniform width and extends for a distance which corresponds to at least half the diameter of the saw blade extending through the slot during cutting.

8. A skid plate assembly as defined in claim 1, wherein the mounting portion further comprises a rotatable connection orientated to allow rotation of the skid plate about an axis substantially parallel to an axis about which the cutting blade rotates during cutting.

9. A skid plate assembly as defined in claim 1, wherein the spring urges the support portion in a direction that would be away from the concrete surface if the skid plate were installed on a saw for use in cutting concrete.

10. A skid plate assembly as defined in claim 1, wherein the spring urges the support portion in a direction that would be toward the concrete surface if the skid plate were installed on a saw for use in cutting concrete.

11. A skid plate assembly as defined in claim 1, wherein the spring deforms the support portion when the skid plate is not resting against the concrete surface for cutting, wherein the support portion is permanently bowed in a direction opposite to the bowing direction caused by the saw on a flat surface, and wherein the support portion is substantially flat when the skid plate is installed on the saw and used to cut concrete.

12. A skid plate assembly as defined in claim 1, wherein the spring causes the relative position of the first and second end portions to move toward one another so that the support portion deforms.

13. A skid plate for use with a concrete saw having a rotating cutting blade with a leading cutting edge, comprising:

a first mounting portion for connection to the saw;

a support portion having a slot through which the cutting blade extends during cutting, the support portion depending from the first mounting portion a sufficient distance that during cutting the support portion supports the surface being cut adjacent at least the leading cutting edge of the blade extending through the slot to cut a groove in the concrete surface; and resilient means communicating with said support portion for applying a bending force on opposing ends of said skid plate to maintain a substantially flat position adjacent a sufficient portion of the cutting blade to reduce raveling of the edges of the groove cut by the blade as the support portion traverses local variations in the flatness of the concrete surface during cutting.

14. A skid plate as defined in claim 13, further comprising a second mounting portion connected to the support portion.

15. A skid plate as defined in claim 14, wherein said means comprises two springs on opposing sides of the slot, and wherein the support portion is permanently bowed in a direction opposite the deformation caused by the saw on a flat surface.

16. A skid plate as defined in claim 13, wherein said means comprises two springs on opposing sides of the cutting blade, and wherein each spring has a spring rate of less than 50 lb/in.

17. A skid plate as defined in claim 13, wherein said support portion is permanently bowed in the same direction as urged by the resilient means, and wherein said resilient means has a spring force of less than about 50 lb/in.

18. A skid plate as defined in claim 13, wherein said support portion is permanently bowed in the same direction as urged by the resilient means, and wherein said resilient means has a spring rate of between about 1–10 lb/in.

19. A skid plate as defined in claim 13, wherein the slot has closed leading and trailing ends which terminate in the skid plate, and wherein the support portion has a thickness of between about 13–16 gage.

20. A skid plate as defined in claim 13, wherein the slot is of substantially uniform width and extends for a distance that corresponds to at least half the diameter of the saw blade extending through the slot during cutting.

21. A skid plate as defined in claim 13, wherein the mounting portion further comprises a rotatable connection orientated to allow rotation of the skid plate about an axis substantially parallel to an axis about which the cutting blade rotates during cutting.

22. A skid plate assembly for a concrete saw having a rotating cutting blade with a leading cutting edge, comprising:

a first mounting portion;

a support portion having a slot through which the cutting blade extends during cutting, the support portion depending from the first mounting portion a sufficient distance so that during cutting the support portion supports the surface being cut adjacent at least the leading cutting edge of the blade extending through the slot to cut a groove in the concrete surface in order to reduce raveling of the surface; and resilient means for communicating with opposing ends of said support portion to exert a bending force on said support portion of sufficient magnitude so the support portion maintains a substantially flat position adjacent a sufficient portion of the cutting blade to reduce raveling of the edges of the groove cut by the blade as the support portion cuts a flat concrete surface, yet allow bending of the support portion to reduce raveling when the support portion traverses local variations in the flatness of the concrete surface of less than about 0.125 inches per foot during cutting.

23. A skid plate assembly as defined in claim 22, wherein the support portion is permanently bowed in a direction corresponding to the direction of bowing caused by said resilient means, and is deformed by an amount that is not sufficient to offset the deformation of the support portion caused when the skid plate is mounted to a saw and used to cut a flat portion of concrete.

24. A skid plate assembly as defined in claim 22, wherein said resilient members have a spring rate of less than 100 lb/in.

25. A skid plate assembly as defined in claim 22, wherein said resilient members have a spring rate of less than about 50 lb/in.

26. A skid plate assembly as defined in claim 22, wherein said resilient members have a spring rate of about 1–10 lb/in.

27. A skid plate as defined in claim 22, wherein the slot is of substantially uniform width and extends for a distance that corresponds to at least half the diameter of the saw blade extending through the slot during cutting.

28. A skid plate as defined in claim 22, wherein the support portion has a thickness of about 13–16 gage.

29. A method of cutting concrete with a saw having a rotating cutting blade with a leading cutting edge that extends through a slot in a support portion to cut the concrete, comprising:

depending a support portion from the saw so that during cutting the support portion supports the surface being cut adjacent at least the leading cutting edge of the cutting blade as it exits from the concrete surface and passes through a slot in the support portion to cut a groove in the concrete surface;

resiliently urging the support portion into a predetermined bowed configuration when the support portion is not in contact with the concrete, while allowing the support portion to flex predetermined amounts when it is in contact with the concrete; and selecting the support portion with sufficiently low stiffness and selecting the resilient urging force to be sufficiently low so as to allow the support portion to flex and accommodate local variations in the flatness of the concrete surface of less than ⅛ inches per foot while maintaining the support portion substantially flat adjacent a sufficient portion of the cutting blade to reduce raveling of the edges of the groove cut by the blade as the support portion traverses local variations in the flatness of the concrete surface during cutting.

30. A method as defined in claim 29, wherein said depending step further comprises depending the support portion from between first and second ends of a skid plate that are mounted to the saw so that the saw exerts a predetermined force on the skid plate.

31. A method as defined in claim 29, comprising the further step of permanently deforming the support portion in a direction that offsets the deformation occurring when the support portion is used to cut concrete on a flat surface, and wherein the amount of the permanent deformation is selected to be at least half the deformation caused by a saw on a flat surface.

32. A method as defined in claim 30, comprising the further step of permanently deforming the support portion in a direction that offsets the deformation occurring when the support portion is used to cut concrete on a flat surface, and wherein the amount of the permanent deformation is selected to be at least half the deformation caused by a saw on a flat surface.

33. A method as defined in claim 29, wherein the resiliently urging step comprises connecting at least one spring member with a spring rate of less than about 50 lb/in so as to resiliently urge the support portion into the bowed configuration.

34. A method as defined in claim 29, wherein the resiliently urging step comprises connecting at least one spring member with a spring rate of between about 1–10 lb/in so as to resiliently urge the support portion into the bowed configuration.

35. A method as defined in claim 29, wherein the step of maintaining the support portion substantially flat adjacent the cutting blade comprises supporting the concrete surface along a length of at least half the diameter of the cutting blade that extends through the slot in the support portion during cutting.

36. A method as defined in claim 29, wherein the step of maintaining the support portion substantially flat adjacent the cutting blade comprises supporting the concrete surface at the location where cutting segments on the cutting blade enter the concrete surface.

37. A method as defined in claim 29, wherein the mounting steps comprise mounting at least one end of the skid plate to the saw with a rotatable connection orientated to allow rotation of the skid plate about an axis substantially parallel to an axis about which the cutting blade rotates during cutting.

38. A method of cutting concrete as defined in claim 29, wherein said cutting step occurs before the concrete has a hardness of about 1200 psi.

39. A method of cutting concrete as defined in claim 29, wherein said cutting step occurs when the concrete surface has a hardness of about 600 to 900 psi.

40. A method of cutting concrete with a concrete saw that cuts grooves in a concrete surface with a rotating cutting blade that rotates about a first axis as the saw traverses a portion of the concrete surface to cut the groove, comprising the steps of:

rotating a cutting blade in the surface of the concrete to cut a groove when the concrete has a hardness of less than about 1700 psi;

movably supporting the saw on the surface of the concrete during cutting by at least one wheel;

depending a slotted skid plate from the saw to support the concrete surface adjacent the cutting blade during cutting, the rotating cutting blade extending through the slot to cut the concrete, the slot being configured relative to the cutting blade to reduce raveling of the concrete surface during cutting;

making the skid plate sufficiently flexible so that it can flex to maintain the support of the concrete surface during cutting adjacent at least the portion of the cutting blade exiting from the concrete;

resiliently urging the ends of the skid plate toward one another with a spring rate of less than 100 lb/in.

41. A method as defined in claim 40, comprising the further step of permanently bowing the skid plate in a direction that offsets the deformation caused by a saw when the skid plate assembly is used to cut concrete on a flat surface, and in an amount that is at least half of the deformation from the saw when cutting on a flat surface.

42. A method as defined in claim 40, wherein the cutting step occurs before the concrete surface has a hardness of about 1200 psi.

43. A method as defined in claim 40, wherein the cutting step occurs when the concrete surface has a hardness of about 600 to 900 psi.

44. A method as defined in claim 40, wherein the resiliently urging step comprises urging the ends of the skid plate toward one another with a spring rate of less than 50 lb/in.

45. A method as defined in claim 40, wherein the resiliently urging step comprises urging the ends of the skid plate toward one another with a spring rate of about 2 to 20 lb/in.

46. A method as defined in claim 40, wherein the step of making the skid plate flexible comprises selecting a support portion of the skid plate to be between about 13–16 gage.

47. A method as defined in claim 40, comprising the further step of resiliently urging the skid plate against the concrete surface.

48. A method of cutting concrete with a saw, comprising the steps of:

rotating a cutting blade in the surface of the concrete to cut a groove when the concrete has a hardness of less than about 1700 psi;

movably supporting the saw on the surface of the concrete during cutting by at least one wheel;

connecting a support portion to the saw so that it depends a predetermined distance from the saw to support the concrete surface adjacent the cutting blade during cutting;

forming a slot in the support portion so that at least the cutting segments of the concrete cutting blade that extend through the slot to cut the concrete are close enough to the sides of the slot to reduce raveling of the concrete when the concrete is cut below 1200 psi hardness;

configuring the support portion so that it can flex during cutting to maintain the support of the concrete surface adjacent at least the portion of the cutting blade exiting from the concrete, when the concrete surface varies in flatness as much as ⅛ of an inch per foot;

resiliently bending the support portion to counteract deformation of the support portion as it is placed against the concrete, and to allow further bending of the support portion to accommodate variations in the flatness of the concrete surface during cutting so that the support portion remains in sufficient contact with enough of the surface of the concrete adjacent the cutting blade to prevent raveling.

49. A method as defined in claim 48, comprising the further step of permanently bending the support portion to partially counteract deformation of the support portion as it is placed against the concrete, the permanent bending counteracting at least half the deformation of the support portion occurring on a flat concrete surface.

50. A method as defined in claim 48, wherein the cutting step occurs before the concrete surface has a hardness of about 1200 psi.

51. A method as defined in claim 48, wherein the cutting step occurs when the concrete surface has a hardness of about 600 to 900 psi.

52. A method as defined in claim 48, wherein the resilient bending step comprises bending the support portion with a spring rate of less than about 50 lb/in.

53. A method as defined in claim 48, wherein the resilient bending step comprises bending the support portion with a spring rate of less than 20 lb/in.

54. A method as defined in claim 48, comprising the further step of resiliently urging the skid plate against the concrete surface during cutting.

55. A method of manufacturing a skid plate for a concrete cutting saw, comprising the steps of:

forming a skid plate to have a support portion depending from at least one mounting portion, the mounting portion being configured to be fastened to a concrete cutting saw and to depend a distance sufficient to allow the support portion to contact the concrete surface;

forming a slot in the support portion of sufficient width to allow a concrete cutting blade to extend through the slot, but small enough so that the sides of the slot are within 0.25 inches of at least the cutting segments of the cutting blade at a leading end of the slot;

configuring the support portion so that it can flex during cutting to maintain the support of the concrete surface adjacent at least the portion of the cutting blade exiting from the concrete, when the concrete surface varies in flatness as much as ⅛ of an inch per foot in the surface upon which the support portion rests; and connecting resilient members to the first mounting portion and a trailing end of the support portion in order to resiliently bend the support portion; and pre-loading the resilient members so they exert a predetermined bending force on the support portion to counteract deformation of the support portion that occurs during use in cutting concrete.

56. A method as defined in claim 55, wherein the step of forming the skid plate comprises forming a first and second mounting portion with the support portion connected to both mounting portions, and wherein the connecting step comprises interposing the resilient members between the two mounting portions in order to resiliently bend the support portion.

57. A method as defined in claim 55, comprising the further step of permanently deforming the skid plate so that the support portion bends in a direction opposite that caused by the saw when cutting on flat concrete.

58. A method as defined in claim 55, comprising the further step of permanently deforming the skid plate so that the support portion bends in a direction opposite that caused by the saw when cutting on flat concrete.

59. A method as defined in claim 55, wherein the step of forming the skid plate comprises selecting the width and length of the slot to reduce raveling when the skid plate is used to cut grooves in concrete having a hardness of between about 900–1200 psi.

60. A method as defined in claim 55, wherein the step of connecting resilient members comprises connecting members with a spring constant of less than about 100 lb/in.

61. A method as defined in claim 55, wherein the step of connecting resilient members to bend the support portion comprises connecting members with a spring constant of less than 2–20 lb/in.

62. A method as defined in claim 55, wherein the step of configuring the support portion so that it can flex comprises the step of selecting the thickness of the support portion to be between about 14–15 gage.

63. A method as defined in claim 55, wherein the step of configuring the support portion so that it can flex comprises the step of selecting the thickness of the support portion to be between about 12–18 gage.

* * * * *